US005746287A

United States Patent [19]

Durham, Jr.

[11] Patent Number: 5,746,287

[45] Date of Patent: May 5, 1998

[54] HAM LADDER

[76] Inventor: Stevenson Durham, Jr., 5619 S. Wolcott, Chicago, Ill. 60636

[21] Appl. No.: 705,294

[22] Filed: Aug. 29, 1996

[51] Int. Cl.[6] ..... A62B 1/06

[52] U.S. Cl. ..... 182/70; 182/196

[58] Field of Search ..... 182/70, 76, 78, 182/129, 196, 197, 198, 199

[56] References Cited

U.S. PATENT DOCUMENTS

| | | | |
|---|---|---|---|
| 433,061 | 7/1890 | Aarons | 182/76 |
| 458,023 | 8/1891 | Kimball et al. | 182/196 X |
| 639,902 | 12/1899 | Mace | 182/76 |
| 806,597 | 12/1905 | Stoker et al. | 182/196 X |
| 1,358,564 | 11/1920 | Leonard | 182/196 |
| 2,388,678 | 11/1945 | Dahlander | 182/70 |
| 3,033,310 | 5/1962 | McLeod | 182/196 |
| 3,344,886 | 10/1967 | Boscarino, Jr. | 182/70 |
| 3,677,366 | 7/1972 | Loeffel | 182/70 |
| 3,809,181 | 5/1974 | Staranick et al. | 182/70 |
| 4,079,811 | 3/1978 | Driskell | 182/70 |
| 4,127,184 | 11/1978 | Strohmeyer | 182/70 |
| 4,164,991 | 8/1979 | Marra | 182/70 |
| 4,445,589 | 5/1984 | Longenecker | 182/76 |
| 4,531,612 | 7/1985 | Sandor | 182/196 |
| 4,655,321 | 4/1987 | Salvarezza | 182/196 |

FOREIGN PATENT DOCUMENTS

| | | | |
|---|---|---|---|
| 2262958 | 7/1993 | United Kingdom | 182/76 |

*Primary Examiner*—Alvin C. Chin-Shue
*Assistant Examiner*—Richard M. Smith
*Attorney, Agent, or Firm*—Patent & Trademark Services; Thomas Zack; Joseph H. McGlynn

[57] ABSTRACT

A collapsible escape ladder within a storage container. The container has an upper lid connected to the lower rung of the ladder. The container's lower section is connected to the ladder's upper rung section and a dwelling's structural component. During an emergency the lid is thrown from a window pulling the rest of the ladder to its full unfurled length. The lower ladder rung is attached to the lid which by its weight stabilizes the ladder while its upper rung is firmly fixed to the container's lower section and dwelling.

5 Claims, 1 Drawing Sheet

HAM LADDER

BACKGROUND OF THE INVENTION

Concerns over fire safety and emergency escape routes have lead to the development of many types of collapsible, compact, strong and easy-to-use escape ladders. Such ladders, no matter how compact, strong and fireproof, must be easy-to-use as in most emergency situations users are under considerable stress and anxiety. The present invention encompasses all of the needs attributed for such ladders especially those concerned with easy-to-use features as will be apparent from a reading of the specification and claims which follow.

DESCRIPTION OF THE PRIOR ART

Many of the prior art fire escape ladders have emphasized self-storing and compact features. For example, U.S. Pat. No. 3,577,366 to Loeffel discloses an escape ladder mounted in a storage cabinet. The Staranick et al. patent (U.S. Pat. No. 3,809,181) describes an escape ladder mounted outside a window. Further, in U.S. Pat. No. 4,164,991 to Marra a storage cabinet for an escape ladder is revealed. And in U.S. Pat. No. 4,079,811 to Driskell the ladder stored in a container with valuables is thrown out the window to unwind and provide an escape route and the recovery of the stored valuables. None of the known prior art discloses an escape ladder which is store in a container wherein the ladder's lower part is attached to part of the container which part can be easily be thrown out during an escape to discharge the attached ladder as detailed in this specification.

SUMMARY OF THE INVENTION

The escape ladder forming the present invention is stored in a closed container having an openable lid. On the lid's underside are a pair of retaining members which are mounted to the bottom rung of the ladder. By removing the lid, it and the attached ladder starting with its bottom rung may easily be thrown out of a window to provide an escape route.

It is the primary object of the present invention to provide for an improved collapsible escape ladder.

Another object is to provide for such a ladder having its own storage container from which it can easily be taken and used.

These and other objects and advantages of the present invention will become apparent to readers from a consideration of the ensuing description and the accompanying drawings.

DESCRIPTION OF THE PREFERRED EMBODIMENT

Figure 1:
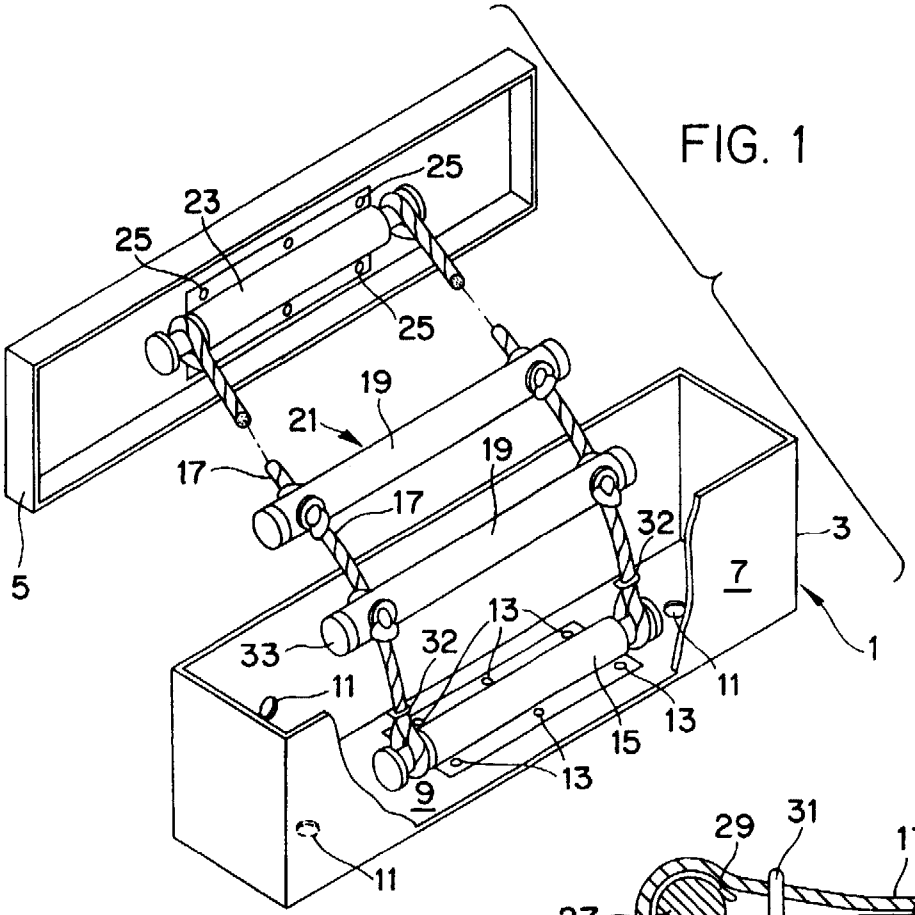
FIG. 1 is a perspective view of the invention's preferred embodiment with a cut away section.

FIG. 1 is a perspective view of the invention's preferred embodiment having part of its lower storage section's front wall cut away. The rectangular box or container 1 has a opened top lower section 3 and a smaller detachable upper lid section 5 which fits over the opened top. For ease in description, part of the lower section's front wall 7 has been cut away. At the lower section's bottom 9 and back are two spaced mounting holes 11 used to install fasteners like lag bolts or wood screws with washers to attach container section 3 to wall studs, floor joints or any other rigid and strong dwelling structural components locate near an escape window. Rigidly attached by several spaced screws 13 to bottom 9 is the ladder's mounting top rung bracket 15. Extending from this bracket are the two spaced ropes 17 having several spaced connected metal rungs 19. Covering these individual rung may be a rubber covering 21. At the ladder's upper terminal end is the lower mounting rung bracket 23 which is rigidly screwed into the lid 5 by several spaced screws 25. For illustration and simplicity purposes the rope and spaced rungs having been shown as discontinued wherein in actuality they are continuously extending from top bracket 15 to lower bracket 23.

Figure 2:
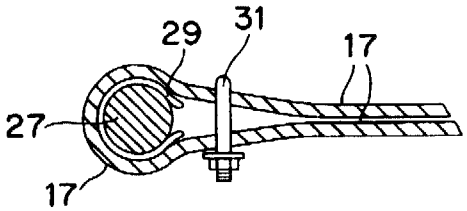
FIG. 2 is a detailed enlarged cross sectional side view of the ladder's bottom rung attachment assembly.

FIG. 2 is a detailed enlarged cross sectional side view of the ladder's bottom rung attachment assembly taken where the left side rope joins to bottom cylindrical metal rung 27. As shown the rope 17 is continuous and loops around rung 27. Interposed between this rung and the loop is a thimble 29 used to prevent premature rope wear as a user places his or her weight on the rung. To keep the looped rope end from moving outwardly a conventional U-shaped clamp 31 having a washer and nut closure is used which extends around the rope's loop before it gets to the rung. The looped free ends of the two spaced ropes 17 are normally fastened to the rope by a conventional fastener such as a metal clip 32. The right rope side is the mirror image of this construction and the top rung uses the same construction as the bottom rung.

Figure 3:
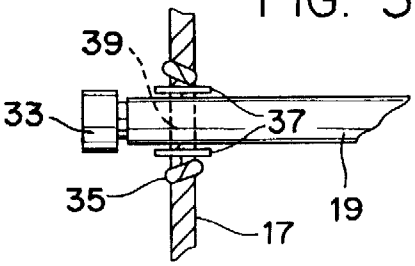
FIG. 3 is a detailed enlarged side view showing the ladder's right side attachment to one of the ladder's rungs.

FIG. 3 is a detailed enlarged right side view showing one of the right side attachment for the ladder's rungs 19, it being understood that the left side is of a mirror image construction.

Each rung, except for the top and bottom rungs which have their own brackets and used the described FIG. 2 construction, has two plastic end caps 33, four rope knots 35, above and below the rung on each side, to maintain the rung is place, and four upper and lower flat washers 37 located between each knot and each rung side where the rope joins to the rung. Extending through each side near the rung 19 end is a rope receiving pass through hole 39.

Figure 4:
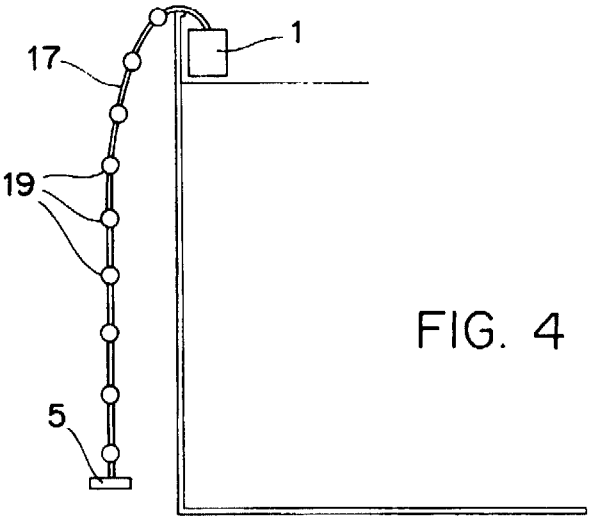
FIG. 4 shows the FIG. 1 ladder deployed from an opened window.

In use, a user would typically deploy the invention as schematically depicted in FIG. 4. The container's lower section 3 would be rigidly fixed to a strong structural component of a building using the holes 11 and lag bolts or screws. The top lid 5 would be removed during an emergency and the window opened. The lid and its attached lower rung would be thrown from the window pulling with it the rest of the ladder except for its attached upper end. Once, the full length of the ladder is unfurled the weight of its bottom lid will help in stabilizing the deployed ladder. Lastly, the user climbs down rung by rung safety to avoid the fire or other emergency.

The storage container components of the invention including its upper lid 5 and lower section 3 may be manufactured of metal by the metal stamping process. Metal stamping is a process whereby flat metal is formed between two parts of a die under tremendous pressure. The metal can be punched, formed and shaped in these dies, many times in one process, and spot welding of separate components can be employed to complete the assembly of sheet metal components. The stamped metal may be stainless steel or plated carbon steel to prevent rusting. The ropes 17 may be manufactured of nylon or steel chain and is available as an "off the shelf" item.

The ladder's rungs 19 are preferably manufactured utilizing the metal extrusion process. The metal extrusion process is one whereby molten, heat softened metal is forced under high pressure through a die, similar to toothpaste being squeezed through the hole in the tube, (in this example the hole in the tube is the die). The metal forms a continuous length in the shape of the die it was squeezed through. In other words the metal would come out continually in the shape of a rod using the nozzle of the toothpaste tube as a die, but would come out in the shape of a square if the die were square. In this case the metal extrusion would take on the shape of the cylindrical rung. Many familiar parts you deal with on a weekly basis were more than likely extruded. Metal rods, bars, and flats and similar items are all manufactured using the extrusion process. The formed aluminum rungs have holes drilled near each of their ends to insert the pass through ropes. After this washer 37 and knots 35 are placed on the rope ends above and below each hole 39 to secure the rungs in place. Next, the upper and lower brackets 15 and 23 are attached to the ropes last rungs and the lid and dwelling structural component. These end brackets may also be manufactured using the metal stamping process and be made of aluminum or steel. The total length of the collapsible ropes used and the number of rungs employed can vary depending on the users needs.

Although the ladder and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An escape ladder and storage container apparatus comprising:

a portable storage container having an openable upper lid and a lower section fastened to a structural component of a dwelling component on an interior of a dwelling;

a collapsible rope ladder having a series of separate rungs including intermediate, top, and bottom rungs, all of said rungs being completely stored within the confines of said portable container;

top and bottom rung retaining members completely stored within said container and fixed to said container's lower section and upper lid, respectively, said top and bottom rung retaining members also being mounted to the ladder's top and bottom rungs, respectively to retain the top rung to the container's lower section and the bottom rung to the lid; whereby said container's lid is opened and separated from the lower section fixed to a structural component on an interior of a dwelling by throwing the lid out of a window to provide a ladder escape route.

2. The invention as claimed in claim 1, wherein said collapsible rope ladder's top and bottom rung retaining members include mounting brackets fixed to the storage container's lower section and lid, respectively.

3. The invention as claimed in claim 2, wherein said ladder's rungs are made of a light metal material and are covered by a protective soft material.

4. The invention as claimed in claim 3, wherein each of said rungs is attached to a rope near each of said rungs ends by end retaining means.

5. The invention as claimed in claim 4, wherein for the intermediate rung said end retaining means comprises rope knots above and below each rung with washers interposed between the rung and each knot.

* * * * *